US006267154B1

(12) United States Patent
Felicelli et al.

(10) Patent No.: US 6,267,154 B1
(45) Date of Patent: Jul. 31, 2001

(54) SYSTEM FOR STORING MIXING AND ADMINISTERING A DRUG

(75) Inventors: Robert Felicelli, Long Grove; Richard W. Grabenkort, Barrington; Con A. Lasaitis, Waukegan; Gary N. Smith, Libertyville; John S. Ziegler, Arlington Heights, all of IL (US)

(73) Assignee: Abbott Laboratories, Abbott Park, IL (US)

( * ) Notice: Subject to any disclaimer, the term of this patent is extended or adjusted under 35 U.S.C. 154(b) by 0 days.

(21) Appl. No.: 09/092,516

(22) Filed: Jun. 5, 1998

(51) Int. Cl.[7] ..... A61J 1/00

(52) U.S. Cl. ..... 141/18; 141/25; 141/326; 604/92

(58) Field of Search ..... 141/2, 11, 18, 141/21, 25–27, 325, 326, 383; 604/92

(56) References Cited

U.S. PATENT DOCUMENTS

| | | | | |
|---|---|---|---|---|
| 4,172,457 | | 10/1979 | Choksi et al. | 604/92 |
| 4,243,080 | | 1/1981 | Choksi et al. | 141/2 |
| 4,493,348 | | 1/1985 | Lemmons | 141/1 |
| 5,806,573 | * | 9/1998 | Kilcoin | 141/21 |
| 6,070,623 | * | 6/2000 | Aneas | 141/27 |

FOREIGN PATENT DOCUMENTS

| | | |
|---|---|---|
| 0422657 | 4/1991 | (EP) . |
| 0761562 | 3/1997 | (EP) . |
| 2111029 | 6/1983 | (GB) . |
| 98/13006 * | 4/1998 | (WO) ..... 141/27 |

* cited by examiner

*Primary Examiner*—J. Casimer Jacyna
(74) *Attorney, Agent, or Firm*—Beth A. Vrioni

(57) ABSTRACT

A container for holding a concentrated drug for a mixing system includes a barrel with a cover structure including a delivery passage at a first end and a closing structure at an opposite, second end. A female Luer lock fitting defines the delivery passage at the first end. The closing structure and the female Luer lock fitting can each be formed integrally with the barrel, or the closing structure can be a slidable stopper. The closing structure may also include a holder. The holder is constructed to move between two positions. In the first position, the holder is in a elevated position on the second end of the barrel. The barrel can vent vapor around the cover piece. In the second position, the holder is depressed onto the barrel and it cannot vent vapor. The cover structure may include a snap-on cover piece to fit over the first end. The cover piece includes the female luer lock fitting. The cover piece functions similar to the holder.

The container can be used in a mixing system which includes a diluent syringe with a barrel having a discharge passage at a first end, and a piston slidably and sealingly disposed in the diluent syringe barrel to define a diluent chamber adjacent the discharge passage. The syringe includes a male Luer lock fitting at its first end for releasably connecting to the female Luer lock fitting of the container. Diluent can be passed from the syringe into the container to mix with the concentrated drug and the resultant mixture can then be drawn from the container for administering to a patient.

20 Claims, 6 Drawing Sheets

SYSTEM FOR STORING MIXING AND ADMINISTERING A DRUG

TECHNICAL FIELD

The present invention relates generally to medical devices for the preparation and administration of drugs and other therapeutic solutions, and more particularly to a drug delivery system which includes a container and a syringe for administering the drug which are pre-filled with a drug and a liquid diluent, respectively.

BACKGROUND OF THE INVENTION

Modem healthcare facilities typically have available a large number of drug or pharmaceutical solutions and other medicaments to administer to patients. Often, drug solutions or premixed solutions may be administered without further preparation. For some drugs, it may be necessary to store the drug in a concentrated form, which may be either liquid or particulate in nature, to maintain the stability and potency of the drug for a reasonable shelf life. Also, concentrated compositions facilitate efficient storage and handling.

To concentrate a drug which is in liquid form, a lyophilization process is used. The drug is subjected to a vacuum in a chamber to remove most of the water and then to concentrate the drug. After lyophilization the drug is sealed and prepared for shipment to a healthcare facility.

At the healthcare facility, the concentrated drug is reconstituted by a syringe mixing system. The concept of separately packaging and then mixing drug and diluent components within a vial and/or a syringe barrel is known. However, many of the known syringe mixing systems require special or unusual components, require many operational steps, and/or require the use of a sharp, hollow needle or cannula which can be hazardous.

Additionally, for some drugs, particularly protein based drugs, a silicone free environment is desirable. A container closing structure which does not require a silicone sealing oil that is typically used in conjunction with reciprocatable stoppers, would be advantageous. It would be also advantageous if the closing structure would maintain sterility of the container during reconstitution.

SUMMARY OF THE INVENTION

The present invention provides a container useable in a system to facilitate the efficient and convenient packaging of a concentrated drug, the reconstitution of the drug in a solution, and the administration of the solution.

The container comprises a cover structure at one end with a first Luer lock fitting that defines a delivery opening and a closing structure at an opposite end.

The first Luer lock fitting is configured to engage a complimentary (second) Luer fitting on a syringe. The first Luer lock fitting includes a thread form for engaging a complimentary thread form on the second Luer lock on the syringe.

The closing structure may be formed either as a substantially closed unitary end wall with the sidewall of a first barrel, or as a stopper or other plug-like member adapted to slide within the first barrel. The use of the unitary end wall avoids the use of a reciprocating grommet or stopper. This is particularly advantageous because silicone sealing/lubricating oil is not required.

As an alternative to the unitary end wall structure, the closing structure includes a stopper adapted to slide within the first barrel and a holder configured to fit onto the first barrel of the container. The holder is capable of moving between two positions with respect to the first barrel. In the first position, the barrel can vent vapor during lyophilization. In the second position, the holder is sealed to the first barrel and it cannot vent vapor.

The holder includes a top wall and a surrounding annular side wall extending therefrom. The top wall includes a central recess with a central hole. The central recess is sized to receive therein a microbial filter. In the first position of the holder, the stopper is held within the holder above the end of the first barrel. The holder includes a hook extending from the top wall for releasably holding the stopper within the holder. The stopper includes inclined wall formations for engagement by the hooks. The holder includes a vent for removing vapors during lyophilization.

During the vacuum phase of the lyophilization process, the holder and stopper held within are positioned in the first elevated position on the barrel with the vent open. After lyophilization is completed, the holder and stopper are depressed downwardly into the second position onto the barrel and the vent is thereby closed by a wall position of the barrel.

The holder and stopper can be forced downwardly by mechanical means assisted by differential pressure on the stopper as the holder vent is closed, and into the second locked position.

When vacuum conditions are terminated in the chamber, the differential pressure within the barrel uncouples the stopper from the holder and draws the stopper further into the barrel. The stopper is sized to tightly, slidably fit within the barrel.

The microbial filter maintains the barrel in a sterile condition while allowing the stopper to slidably move within the barrel. That is, the filter allows the air to pass into and out of the barrel between the stopper and the barrel open end, during movement of the stopper.

The cover structure with first Luer lock fitting of the container can be formed as a unitary structure with the first barrel, or the first barrel can have an otherwise open end which is substantially closed by an overfitting cover piece having an integral Luer lock fitting. The cover piece can be snap fitted onto the barrel using a flange of the first barrel for engagement.

The container has a first removable closure or plug engaged to the first Luer lock fitting that temporarily seals the delivery opening.

Similar to the function of the holder, the cover piece can be constructed to move between two positions with respect to the first barrel. In a first, elevated position, the first barrel can vent vapor through or around the cover piece during lyophilization. After lyophilization is completed, the cover piece can then be snapped down onto the first barrel by mechanical means to a second position. In this second position, the cover piece is sealed to the first barrel and the barrel cannot vent vapor.

With all embodiments of the closing structure or the cover structure the sterility of the drug is maintained during lyophilization and reconstitution.

As previously described, the container includes a cover structure and closing structure. In one embodiment, both the cover structure and closing structure are each constructed entirely as a unitary structure with the barrel of the container. In another embodiment, the cover structure is constructed as a unitary structure with the barrel and the closing structure is constructed to include or employ the stopper and holder described above. In yet another embodiment, the cover structure includes the moveable cover piece described above and the closing structure is constructed as a unitary structure with the barrel.

The container of the present invention is particularly adapted for use with a mixing system which also includes a syringe. The syringe has a second or syringe barrel and a Luer lock fitting that defines a discharge opening into a discharge passage of the syringe barrel. A removable closure is engaged to the Luer lock fitting and seals the discharge opening. A piston is slidably and sealingly disposed in the syringe barrel to define a diluent chamber adjacent the discharge passage.

The Luer lock fittings of the container and syringe are mutually engageable for coupling the drug-containing container end-to-end with the diluent-containing syringe to establish fluid communication between the delivery passage and the discharge passage after the removable closures are removed from the container and the syringe.

A plunger is provided in the diluent syringe and engaged with the piston so that movement of the plunger inwardly will force the diluent into the connected drug-containing container for reconstituting the drug in solution form. The reconstituted drug in solution can then be drawn from the container into the syringe by outward movement of the plunger. The syringe can then be removed from the container, and a tube or needle can be connected to the Luer lock fitting at the discharge end of the syringe. The plunger can then be pushed inwardly to administer the solution to a patient.

The Luer lock fittings may be provided in the form of male and female Luer lock fittings. The drug-containing container may be provided with a female Luer lock fitting at its discharge end defined by a Luer taper nozzle having a male Luer thread form, and the syringe may be provided with a male Luer lock fitting including a Luer taper nozzle surrounded by a female threaded collar having a dual lead female thread form.

Alternatively, the above-described female Luer lock fitting on the container may be instead incorporated on the barrel of the syringe, while the above-described male Luer lock fitting on the barrel of the syringe may be instead incorporated on the barrel of the container.

Further, according to another aspect of the invention, a smaller quantity or partial dose of the reconstituted drug solution may be administered. To this end, after the dry drug-containing barrel is completely filled with all of a the liquid diluent from the syringe barrel, a portion of the reconstituted drug solution can be drawn back into the syringe barrel. The container and the syringe can then be disconnected, and the smaller quantity of the reconstituted drug solution can be administered to a patient.

After the smaller quantity has been administered, the empty syringe barrel can be reconnected to the container barrel containing the remaining portion of the reconstituted drug solution, and a further smaller quantity or partial dose of the reconstituted drug solution can be again drawn into the diluent syringe barrel for subsequent administration to a patient.

The drug packaging, mixing, and delivery system of the present invention is preferably configured so that the entire arrangement can be used once and disposed of economically.

Other features and advantages of the present container and the drug packaging, mixing, and delivery system will become readily apparent from the following detailed description, the accompanying drawings, and the appended claims.

DETAILED DESCRIPTION

Figure 1:
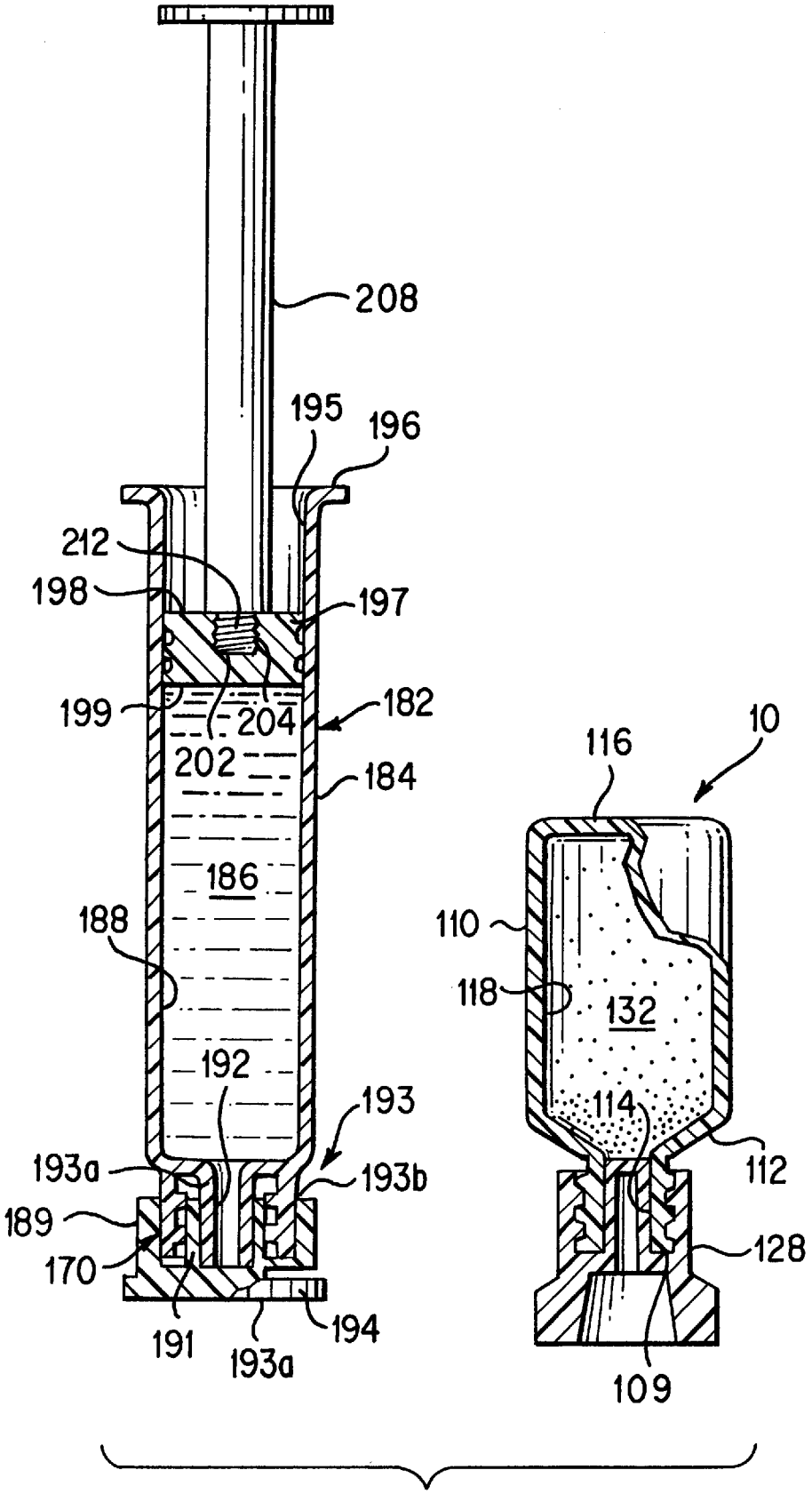
FIG. 1 is a partial cross-sectional view showing a liquid diluent in a diluent syringe barrel with a plunger and piston in a first position, and a concentrated-drug-containing-container.

While the present invention is susceptible of embodiment in various forms, there is shown in the drawings and will hereinafter be described only some embodiments, with the understanding that the present disclosure is to be considered as an exemplification of the invention, and is not intended to limit the invention to the specific embodiments described and illustrated.

A presently preferred form of the present invention comprises a container for storing a concentrated drug (especially a lyophilized drug in dry, powder form), the container having a Luer lock fitting for releasable attachment to a second container such as a syringe. A system using the container is contemplated for storing the concentrated drug, for separately storing a diluent, for combining the drug and diluent to reconstitute the drug in solution form for administration, and for dispensing the solution.

Figures 2, 2A, 2B:
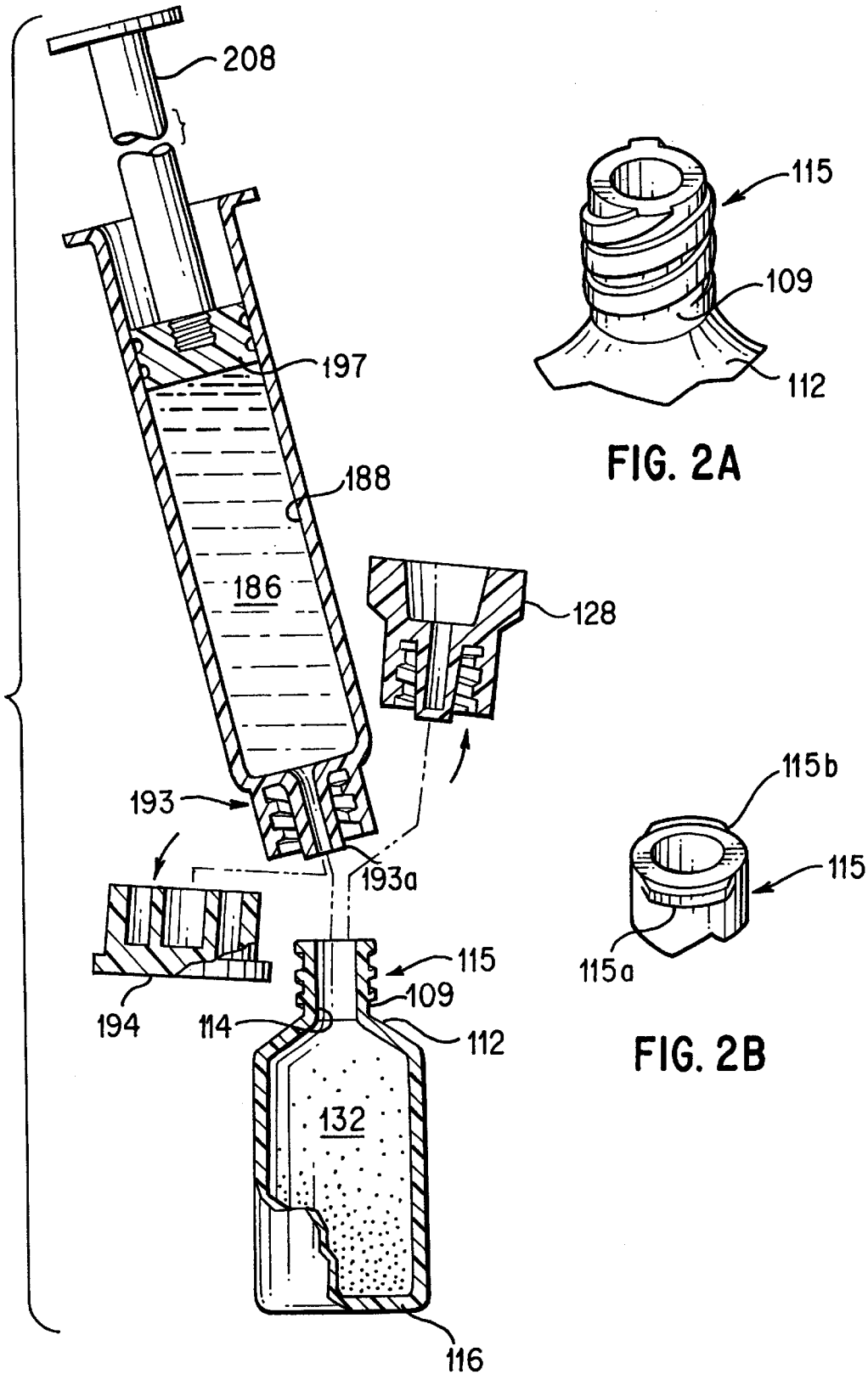
FIG. 2 is an exploded cross-sectional view of the syringe barrel and the container of FIG. 1 in a further stage of operation.
FIG. 2A is an enlarged fragmentary perspective view of a nozzle of the container of FIG. 2.
FIG. 2B is an enlarged fragmentary perspective view of an alternate nozzle for the container of FIG. 2.

An exemplary embodiment includes a concentrated drug container 10 having a barrel 110 as illustrated in FIGS. 1 and 2. The barrel 110 is preferably cylindrical and preferably has a cylindrical interior surface 118. The barrel 110 is closed by a closing structure which has a closed end 116 formed as a unitary structure with the barrel and includes a substantially closed opposite end or delivery end 112 with passage 114 defined by a female Luer lock fitting 109 which is adapted for receiving a male Luer lock fitting. The female Luer lock fitting 109 is surrounded by a conventional Luer lock dual lead male thread form 115 as shown in FIG. 2A.

FIG. 2B illustrates an alternate male thread form 115' which comprises oppositely disposed lugs 115*a,* 115*b* which form the male thread portion of a double-start right hand thread connection. The lugs 115*a,* 115*b* are sized and shaped to be engaged by, and progress in, a female thread form (such as a thread form 193*c* described below).

The passage 114 is tapered, and a male Luer nozzle 193*a* (described below) is compatibly tapered, such as with a 6% Luer taper according to International Standard ISO 594/1, First Edition 1986-06-15, Ref. No. ISO 594/1-1986(E), entitled: "Conical Fittings with a 6% (Luer) taper for syringes, needles and certain other medical equipment-Part 1." The dimensions of the Luer lock fittings can be in accord with International Standard ISO 594-2 First Edition 1991-05-01 Reference Number ISO 594-2:1991(E), entitled: "Conical fittings with a 6% (luer) taper for syringes, needles and certain other medical equipment-Part 2: Lock fittings" and/or ANSIIHIMA MD70.1-1983 (Revision of ANSI 270.1-1955) entitled: "American National Standard for Medical Material-Luer Taper Fittings-Performance." The delivery end 112 may alternatively be a male Luer lock fitting for engagement with a female Luer lock fitting.

The delivery passage 114 is preferably temporarily closed with a removable threaded closure 128 which may engage the nozzle 109 by thread means or by means of another suitable, releasable attachment system. As used herein, the term "removable" means "openable" in the sense of removing an occlusion. The closure 128 could be designed to remain attached to the first barrel after being opened or punctured. The closure 128 could be designed to be recessed within the delivery end 112. The closure 128 could be a valve or could include a valve.

The first barrel 110 defines a first chamber or mixing chamber which can be filled with a predetermined quantity of a concentrated medical solution, concentrated liquid drug, or dry drug 132 (e.g., a lyophilized drug in powder form) which has a predetermined drug concentration.

An exemplary embodiment of the syringe mixing system also includes a diluent syringe 182 as illustrated in FIG. 1. The diluent syringe 182 includes a second barrel 184 that holds a diluent liquid 186. The second barrel 184 is preferably cylindrical and preferably has a cylindrical interior surface 188.

The second barrel 184 has a discharge end 190 defining a discharge passage 192. The exterior surface of the discharge end 190 defines a male Luer lock fitting 193 including a nozzle 193*a* and a surrounding collar 193*b* with a conventional female Luer lock dual lead female thread form 193*c*. An exterior closure or cap 194 is provided for sealingly closing the discharge passage 192 of the diluent syringe 182. The cap 194 has a male-Luer-nozzle receiving cap piece 191 and a surrounding collar 189 which together frictionally grip the Luer lock fitting 193. Alternatively, other suitable methods of attaching the closure 194 to the discharge end 190 may be employed, for example by threading.

As a further alternative, the Luer lock connection system illustrated for the embodiment shown in FIG. 1 may be reversed. That is, the Luer lock fitting 109 having the thread form 115 (or 115') on the barrel 110 may be instead provided on the diluent syringe barrel 184, and the Luer lock collar 193*b* with the female thread form 193*c* may be provided on the end of the barrel 110.

The diluent syringe barrel 184 has an opposite, open end 195 with a flange 196. A piston (or "grommet", or "movable seal", or "stopper") 197 is slidably and sealingly disposed in the diluent syringe barrel 184 between the barrel open end 195 and the barrel discharge end 190 to define a diluent chamber for containing the diluent liquid 186. The piston 197 is preferably made from a resilient material such as a synthetic elastomeric material.

The piston 197 has an outer side 198 facing the barrel open end 195 and has an inner side 199 facing the barrel delivery passage 192. At the piston outer side 198, the piston defines a receiving cavity 202 with a surrounding female thread form 204. The receiving cavity 202 receives the distal end of a plunger 208. The plunger 208 distal end has a male thread form 212 for threadingly engaging the female thread form 204 in the piston 197.

It is contemplated that the container 10, including the concentrated drug 132, would be packaged together with the diluent syringe 182 containing the diluent 186. However, the concentrated drug container 10 and the diluent syringe 182 could be packaged and supplied separately. Advantageously, the container 10 can be an 8 mm glass or plastic tube or vial and the diluent syringe 182 can be a 50 ml diluent syringe.

Figure 3:
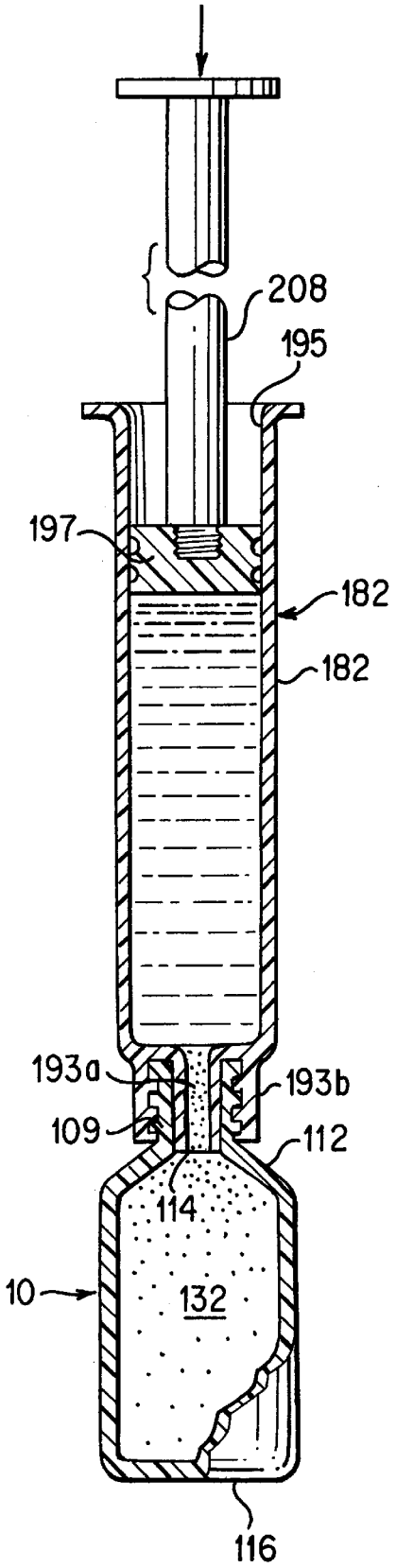
FIG. 3 is a cross-sectional view showing the container of FIG. 1 connected to the diluent-containing syringe barrel just prior to the initial reconstitution of the concentrated drug within the container.

In any case, in order to administer the drug, the concentrated drug 132 must be reconstituted to the diluted, solution form. To this end, the diluent 186 is mixed with the concentrated drug 132. This is accomplished as illustrated in FIG. 2 by removing the concentrated drug-containing barrel removable closure 128, removing the diluent syringe barrel closure 194, and screwing the two barrels together as illustrated in FIG. 3.

When the closure 194 is removed from the diluent syringe barrel 184, the diluent liquid 186 will not drain out of the discharge passage 192 because of the small diameter of the passage 192 and because of the inability of air to enter the chamber and continually equalize the interior pressure with the ambient pressure to permit the liquid to drain out.

When connected together, the male Luer nozzle 193*a* is sealingly received into the passage 114 of the female Luer fitting 109 and the male thread form 115 (or 115') threadingly engages the female thread form 193*c* of the collar 193*b*.

After the two barrels are properly connected, the plunger 208 is pushed downwardly to force the piston 197 against the diluent 186. This expresses the diluent 186 from the diluent chamber through the diluent syringe barrel discharge passage 192 and through the barrel delivery passage 114 into the chamber in the concentrated drug barrel 110. The diluent 186 combines with the concentrated drug 132 for reconstitution of the drug in solution form 132'. The assembly can be shaken to insure good mixing.

In some applications, it may not be necessary or desirable to immediately administer the full quantity of the reconstituted solution in the container barrel 110. The present invention accommodates such situations and permits a smaller quantity or partial dose of the solution to be administered.

Figure 4:
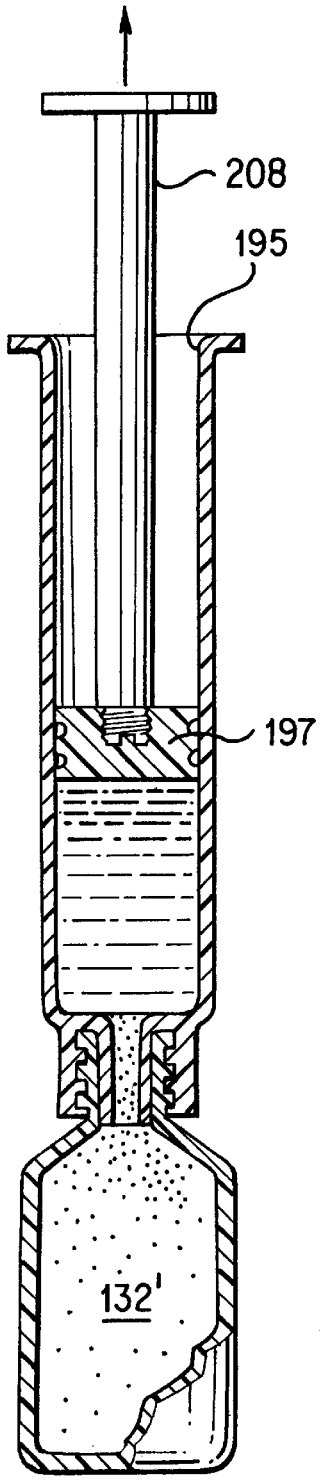
FIG. 4 is a cross-sectional view similar to FIG. 3, but FIG. 4 shows the diluent expressed into the drug-container to form a reconstituted solution.

To this end, the plunger 208 is pulled outwardly in the syringe barrel 184 as illustrated in FIG. 4. This draws a desired quantity of the reconstituted solution into the syringe barrel 184.

In any event, after the desired quantity of reconstituted drug solution has been transferred to the syringe barrel 184, the syringe barrel 184 can be disengaged from the barrel 110. Then the syringe barrel 184 holding the desired quantity of drug solution may be connected to a suitable delivery system for administration to a patient (e.g., the discharge nozzle 193*a* can be attached to a delivery tube that has a female Luer lock connector for receiving the nozzle 193*a* and for engaging the threads on the collar 193*b*).

Subsequently, after administering the partial dose, the empty syringe barrel 184 can be reconnected to the reconstituted drug solution container 10, and another small quantity or partial dose of the drug solution can be drawn into the syringe barrel 184 for subsequent administration to a patient.

Figure 5:
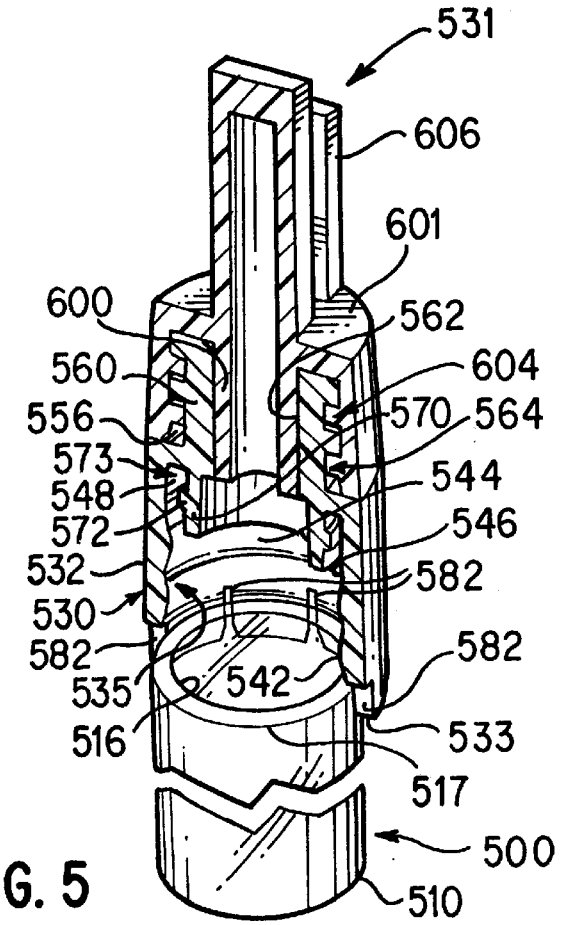
FIG. 5 is a perspective view, shown partially in section, of an alternate top portion of the container shown in FIG. 3 in an initial stage during lyophilization.

FIG. 5 illustrates an alternate concentrated-drug-containing container 500 which is particularly suited for the initial lyophilization of the concentrated drug within the container with an alternate cover structure. The container includes barrel 510 with an open top end 516 surrounded by an outwardly directed annular flange 517. The barrel 510 can be, for example, an 8 mm glass vial. The cover structure includes a cover piece 530 or holder having a surrounding side wall 532 which is placed onto the container barrel 510. A removable plug 531 is fit onto or held by the cover piece 530. The cover piece 530 and the plug 531 are preferably injection molded bodies.

The surrounding annular side wall 532 is sized to be slightly larger than the flange 517 at a distal end 533 of the side wall. An inside surface 535 of the side wall 532 has an irregular shape including an undulating contour having a bottom annular wall portion 542, a second annular wall portion 544, a third annular wall portion 546, and a fourth annular wall portion 548. Between each of the wall portions 542, 544, 546, 548 is a discontinuity or crease. The wall portions 542, 544, and 546 each have a convex profile facing the barrel 510. The fourth wall portion 548 has a substantially flat profile.

In the position shown in FIG. 5, the cover piece or holder 530 is supported on the flange 517 by the first annular wall portion 542 which has, at about its half-height, an inside diameter slightly smaller (in a relaxed state) than the outside diameter of the flange 517.

The surrounding annular side wall 532 is substantially closed at a top thereof by a top wall 556 having a female Luer lock fitting including a nozzle 560 extending therefrom. The nozzle 560 has a tapered Luer opening 562 for receiving a male Luer fitting. Surrounding the nozzle 560 is a male thread form 564 for a female Luer lock fitting. The male thread form can be either thread form shown in FIGS. 2A or 2B.

Extending downwardly from an inside surface of the top wall 556 is a seal ring 570 having on an outside thereof an annular seal bead 572 generally in opposition to the fourth wall portion 548. The fourth wall portion 548, top wall portion 556 and seal ring 570 form a seat area 573 for receiving the flange 517. The convex contour of the third wall portion 546 locks the cover piece 530 or holder to the barrel 510.

Figure 6:
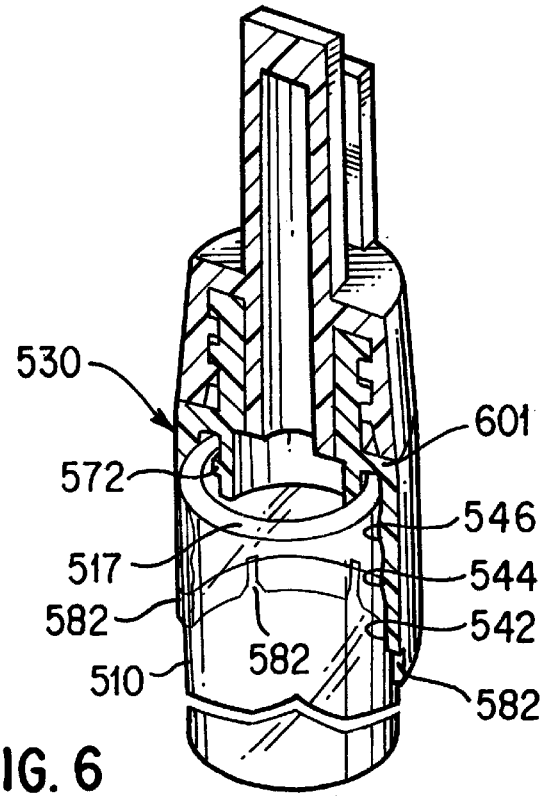
FIG. 6 is a perspective view similar to FIG. 5, but with the container in a final stage of lyophilization.

Extending upward from the distal end 533 of the holder 530 are vents in the form of a plurality of vertical slots 582 which allow venting of the container 500 when the holder is in the position of FIG. 5 but which are closed by the barrel 510 when the holder is put into the depressed position of FIG. 6.

As illustrated is FIG. 6, the cover piece or holder 530 has been depressed downwardly. The first, second, and third wall portions have been deflected outwardly or stretched by the flange 517 to allow the flange 517 to pass to the seat area 573. The flange 517 is snapped into the seat area 573 and trapped by a protruding portion of the third wall portion 546, the flange located between the seal bead 572 and the wall portion 548.

The seal bead 572 is composed of resilient material to effect a seal between the barrel and the cover piece or holder 530.

During lyophilization, the container 500 is arranged in the configuration and position shown in FIG. 5. Water vapor from inside the barrel 510 is vented through the slots 582, particularly those portions of the slots which are exposed above the flange 517. After lyophilizing, the plug 531 and cover piece 530 are pressed downwardly by conventional mechanical means of the lyophilization apparatus (not shown). The wall portions 542, 544, 546 are resiliently deflected outwardly or stretch to ride over the flange 517 until the flange is seated within the annular seat 573, as shown in FIG. 6. The bead 572 is moved within the barrel 510 to seal the cover piece or holder 530 thereto. In this locked position, the slots 582 are closed by the wall material of the barrel 510.

The removable plug 531 includes a male Luer nozzle plug 600 which tightly fits within the inside surface 562 of the female Luer lock nozzle 560. The nozzle plug 600 is connected via a top wall 601 to a surrounding collar 604 having female threads which engage the male thread form 564 of the nozzle 560. A handle piece 606 extends from the top wall 601 upwardly and provides a user-grippable member for removing the plug 531.

To reconstitute the lyophilized and concentrated drug within the container 510, the plug 531 is removed by unscrewing it from the female Luer lock fitting 560. Once the plug is unscrewed, the syringe barrel 184 can be attached to the Luer lock fitting 560, as shown in FIG. 3.

Figure 7:
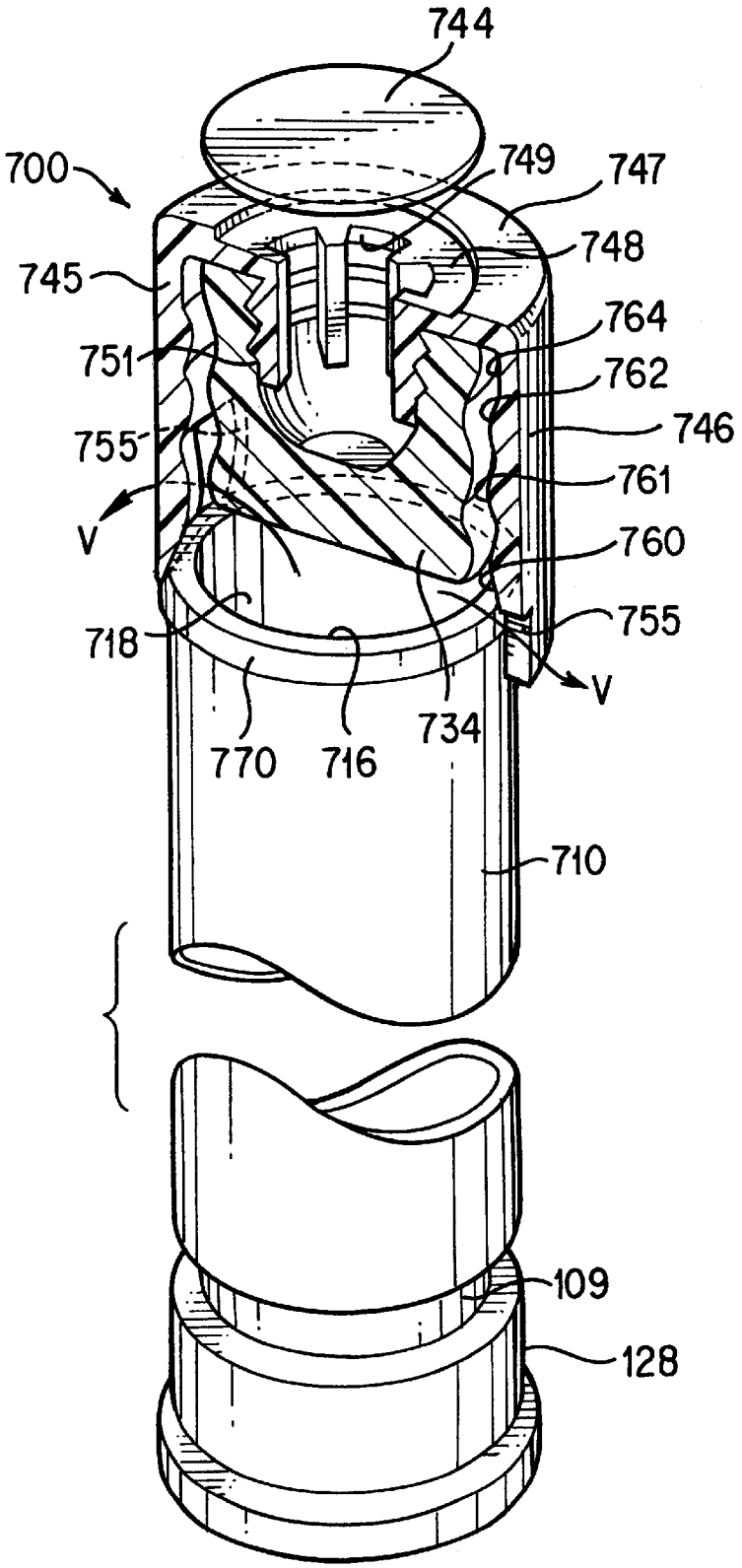
FIG. 7 is a perspective view shown partially in section, of an alternate bottom to the container shown in FIG. 1 in an initial stage of lyophilization.
Figure 8:
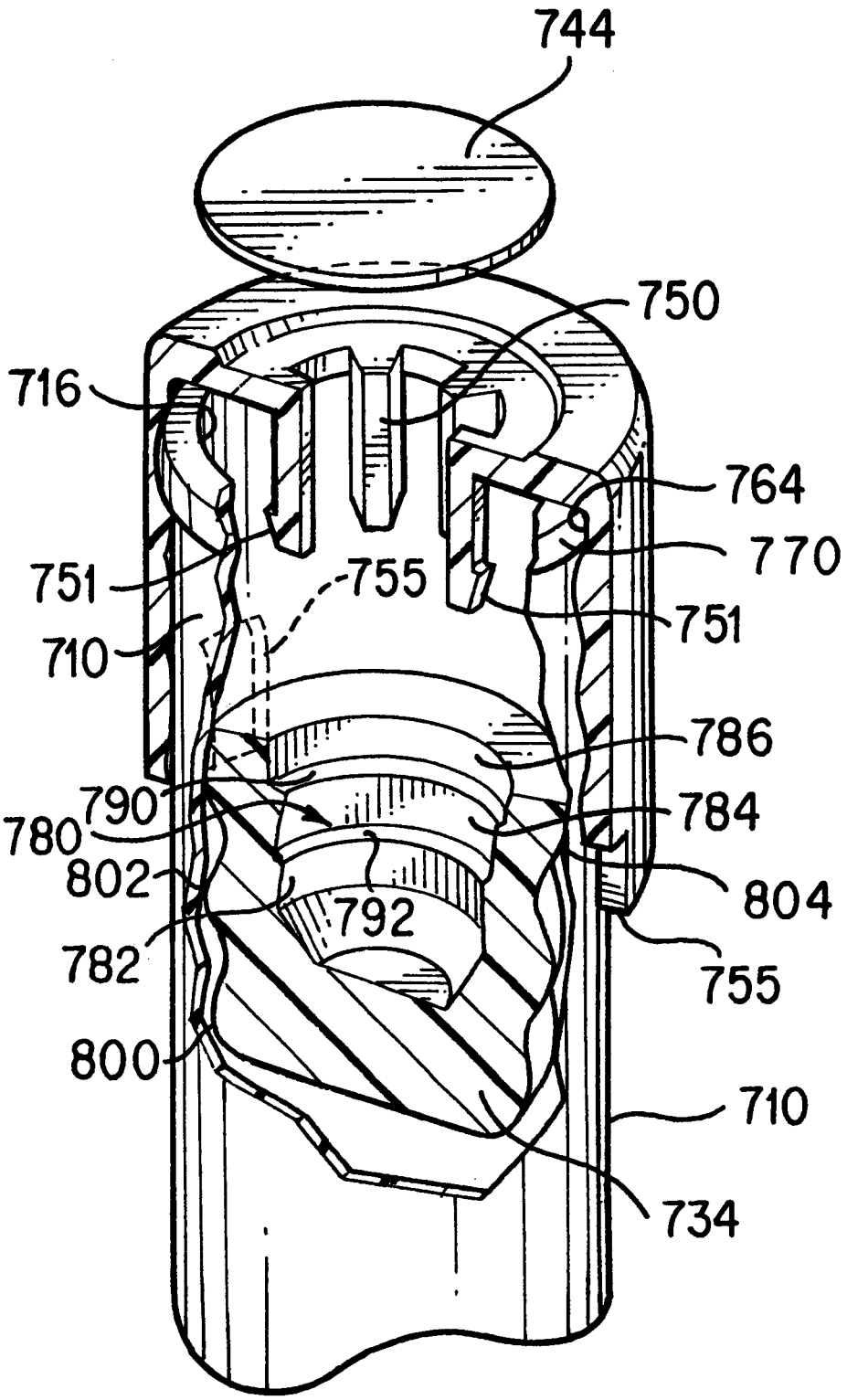
FIG. 8 is a perspective view, shown partially in section, of the bottom shown in FIG. 7 in a further stage of lyophilization.

In an alternate embodiment described in FIGS. 7 and 8, a container 700 includes a closing structure which uses a reciprocatable stopper 734 to close the container in lieu of the unitary bottom wall 116 shown in FIG. 1. This configuration offers some advantages, particularly for initial lyophilization of a drug stock to produce the concentrated drug.

The container 700 is shown inverted with its bottom elevated. This would be the container orientation during lyophilization. The closing structure also includes a holder 745 which is supported substantially above an open end of an alternate barrel 710. The holder releasably supports the stopper 734 above the open end 716. The reciprocatable stopper 734 is sized and shaped to be fit into the alternate barrel 710. The stopper 734 is preferably made from a resilient material such as a synthetic elastomeric material or rubber, to seal against an inside surface 718 of the alternate barrel 710.

The holder 745 is preferably an injection molded plastic body which includes a surrounding annular side wall 746 substantially closed at a top side by a top wall 747. The top wall 747 includes a central recess 748 with a central hole 749. The central recess 748 is sized to receive therein a microbial filter 744 (shown displaced in partial exploded view for clarity), which is secured by insert molding, or heat staking, or by adhesive into the recess, and which covers the central hole 749. The microbial filter is disk shaped and can be composed of a PALL or FILTER TECH microbial filter element. A plurality of hooks 750 extending downwardly from the recess have outwardly directed barbs 751.

The side wall 746 of the holder 745 includes one or more slotshaped vent windows 755 which allow water vapor V to escape the barrel 710 during lyophilization. The slot-shaped vent windows 755 extend upward to a limited extent such that when the holder is in the position with respect to the barrel 710 shown in FIG. 7 water vapor can escape from over the top of the barrel open end 716 and radially outwardly through the vent windows 755. When the holder 745 is in the position shown in FIG. 8, the window vents are closed by the barrel 710. A plurality of window vents 755 can be spaced around a circumference of the holder 745.

The holder 745 has an irregular inside surface having discrete annular undulations 760, 761, 762 and an annular flat wall 764. The undulations are slightly convex annular rings separated by creases. In the position shown in FIG. 7 the lowest undulation 760 has an inwardly directed contour which at approximately its half-height has an inside diameter less than an outer diameter of the flange 770 of the barrel 710. This contour provides an inwardly extending annular portion 700 which supports the holder 745 on the flange 770 of the barrel 710. When the holder 745 is pushed downwardly as shown in FIG. 8, the undulations 760, 761, 762 will be outwardly deflected or stretched to ride over the flange 770 until the flange 770 is captured in a seat defined by the wall 764, the bottom surface of top wall 747, and the annular undulations 762. The convex contours of the annular undulation 762 locks the holder 745 to the flange 770. The undulations 760, 761, 762 assist in providing an effective seal on an outside of the barrel 710.

As shown more clearly in FIG. 8, the stopper 734 includes a central socket 780 with coaxial annular walls 782, 784, 786 which are vertically spaced and which are inclined radially inwardly in a vertically rising direction. The annular walls 782, 784, 786 are interconnected by intermediate annular walls 790, 792 which are inclined radially outwardly in a vertically rising direction.

When the stopper 734 is pushed into the holder 745 during assembly, the hook barbs 751 resiliently ride over the walls 786, 790, 784, and 792, to be engaged frictionally against the wall 782 to hold the stopper 734 in place, and coupled to the holder 745.

After lyophilization is completed the holder 745 and assembly, including the holder 745, the microbial filter 744, and the stopper 734, are pushed downward from the position shown in FIG. 7 to the position shown in FIG. 8 by conventional mechanical means of the lyophilization apparatus (not shown). The atmosphere surrounding the container is increased from below atmospheric pressure (vacuum) to atmospheric pressure. The pushing is assisted by differential air pressure force on opposite sides of the stopper as the stopper seals inside the barrel 710 and the ambient pressure outside the container increases. The greater pressure on an outside of the stopper 734 forces the stopper 734 to disengage from the holder 745. Thereafter, the stopper 734 is free to move within the barrel in response to the differential pressure on opposite sides of the stopper, taking into consideration the force of friction between the stopper and the inside surface 718 of the barrel 710.

The stopper has on an outside surface thereof, a plurality of annular undulations 800, 802, 804, i.e., convexly contoured rings, which assist in providing an effective seal between the stopper 734 and the inside surface 718 of the barrel.

It will be appreciated that the microbial filter 744 maintains the sterility of the inside surface 718 of the barrel 710 before and during the outward movement of the stopper 734 (as the dry drug and the diluent are mixing while the diluent is discharged from the syringe barrel to the mixing chamber of the diluent barrel). The filter 744 allows air to pass into and out of the barrel 710 in the space between the filter and the stopper 734, during movement of the stopper 734. For example, when the diluent is expressed into the container 700 from the syringe, the stopper will move toward the filter and air will pass out of the barrel through the filter. When reconstituted drug in solution is drawn from the container, the stopper will move away from the filter and air will be drawn into the barrel through the filter.

Use of the present system promotes efficient and effective preparation, packaging, reconstitution, and delivery of a drug. Further, the system avoids the use of a sharp needle or cannula, thereby eliminating puncture hazards and further reducing the number of components.

From the foregoing, it will be observed that numerous modifications and variations can be effected without departing from the true spirit and scope of the novel concept of the present invention. The present disclosure is to be understood broadly and no limitation with respect to the specific embodiments herein is intended or should be inferred. The disclosure is intended to cover, by the appended claims, all such modifications as fall within the scope of the claims.

What is claimed is:

1. A container for storing a concentrated drug, comprising:

a barrel having a surrounding wall between a first end and a second end, for containing a concentrated drug; and a cover structure substantially closing said barrel at said second end thereof, said cover structure having a Luer lock fitting including a delivery nozzle with a Luer tapered opening for receiving a male Luer lock nozzle, and a male thread form around an outside of said delivery nozzle for engaging a female thread form of a collar of a male Luer lock fitting, said cover structure comprises a cover piece including a surrounding side wall, said surrounding side wall includes an inwardly directed portion for engaging said barrel and a vent for establishing fluid communication between the barrel interior and exterior, said barrel includes an outwardly directed flange at said second end, wherein said cover piece is moveable between a (1) first position where said cover piece is supported on said flange by said portion and said vent is open and (2) a second position where said cover piece is depressed on said barrel in a locked position and said vent is closed.

2. The container in accordance with claim 1 further comprising a closing structure which closes said barrel at the first end thereof.

3. The container in accordance with claim 2 wherein said closing structure comprises an end wall formed as a unitary structure with said barrel.

4. The container in accordance with claim 1 wherein said cover structure comprises a separate cover piece and wherein said barrel includes an outwardly directed annular flange at said second end, said separate cover piece includes a surrounding side wall which is sized to overfit said barrel at said second end, said surrounding side wall including an inwardly directed member for capturing said annular flange when in a locked position to couple said cover piece to said barrel.

5. A container for holding a concentrated drug, comprising:

a barrel having a first end and an open second end; and a structure including a holder adapted to be mounted to said open second end movable between a first position and a locked, second position relative to said second end, said holder having a vent for venting vapor from inside said barrel to outside said barrel, said vent is open when said holder is in said first position and said vent is closed when said holder is in said locked second position, said holder including a surrounding side wall sized to overfit said open second end of said barrel, said surrounding side wall having a radially inwardly directed portion to hold said holder in said first position.

6. The container according to claim 5 wherein said radially inwardly directed portion is resiliently deflectable outwardly to allow said holder to be moved into said locked, second position.

7. The container according to claim 6 wherein said holder includes a top wall and a surrounding side wall extending from said top wall, said surrounding side wall includes an inwardly directed wall portion for capturing said annular flange proximate said top wall when said holder is in said locked, second position.

8. The container according to claim 7 wherein said top wall includes a delivery passage.

9. The container according to claim 5 wherein said first end has a delivery passage and said barrel includes a Luer lock fitting at said first end which has an inside surface which defines said delivery passage.

10. The container according to claim 9 wherein said Luer lock fitting comprises a female Luer lock fitting including a nozzle having a bore defining said inside surface, said bore having a Luer taper and a thread form on an outside of said nozzle.

11. The container according to claim 5 wherein said holder includes side portions arranged to grip an outside surface of said barrel.

12.The container according to claim 5 wherein said vent comprises at least one slot defined through said holder.

13. The container according to claim 5 wherein said barrel includes a flange around said open second end, said holder has a surrounding side wall with an undulating inside surface for engaging said barrel.

14. The container according to claim 13 wherein said undulating inside surface of said surrounding side wall includes (1) a convex annular wall portion having an inside diameter which is less than an outside diameter of said flange such that said holder is supported on said flange and (2) a second convex annular wall portion arranged proximate said top wall and having a minimum inside diameter which is less than the diameter of said flange for capturing said flange proximate said top wall when said holder is in said locked second position.

15. A container for storing a concentrated drug, comprising:

a barrel having a surrounding wall between a first end and a second end, for containing a concentrated drug; and a cover structure adapted to be mounted to said second end, said cover structure movable from a first position to a second locked position on said barrel, said cover structure having a Luer lock fitting including a delivery nozzle with a Luer tapered opening for receiving a male Luer lock nozzle, said cover structure includes a cover piece comprising a top wall and a surrounding annular side wall extending therefrom adapted to overfit said barrel at said second end, said barrel includes an outwardly directed annular flange at said second end, said cover piece includes an annular ring extending from top wall, said top wall, annular side wall and annular ring defining a seat area for receiving said annular flange when in said second locked position to couple said cover piece to said barrel.

16. The container in accordance with claim 15 wherein said surrounding annular side wall includes an inwardly directed portion for holding said cover piece in said first position on said barrel.

17. The container in accordance with claim 16 wherein said surrounding annular side wall also includes a vent for exposing the inside of said barrel to the outside of said barrel when said cover piece is in said first position, said inwardly directed portion is disengageable to allow said cover piece to be pressed onto said barrel to said second locked position which closes said vent.

18. The container in accordance with claim 15 wherein said Luer lock fitting comprises a female Luer lock nozzle having a surrounding thread form.

19. The container in accordance with claim 15 wherein said barrel comprises a glass vial.

20. The container in accordance with claim 15 wherein said barrel comprises a glass bottle.

* * * * *